US005788591A

United States Patent [19]

Decker

[11] Patent Number: 5,788,591

[45] Date of Patent: Aug. 4, 1998

[54] PRACTICE BASEBALL

[75] Inventor: Thomas J. Decker, Omaha, Nebr.

[73] Assignee: Decker Products Co., Omaha, Nebr.

[21] Appl. No.: 189,140

[22] Filed: Jan. 26, 1994

[51] Int. Cl.[6] ..... A63B 37/00

[52] U.S. Cl. ..... 473/602

[58] Field of Search ..... 223/60 R, 60 A, 223/60 B, 26 R

[56] References Cited

U.S. PATENT DOCUMENTS

| | | | |
|---|---|---|---|
| 2,278,649 | 4/1942 | Dickson et al. | 273/60 R |
| 4,201,384 | 5/1980 | Barber | 273/199 R |
| 4,211,407 | 7/1980 | Tomar | 273/60 B |
| 4,286,783 | 9/1981 | Newcomb et al. | 273/26 R |
| 4,614,339 | 9/1986 | Schanwald | 273/26 R |

OTHER PUBLICATIONS

Worth Catalogue, "Junior Balls", Jan. 9, 1976, p. 7.

*Primary Examiner*—Steven B. Wong

*Attorney, Agent, or Firm*—Zarley, McKee, Thomte, Voorhees & Sease; Mark D. Frederiksen

[57] ABSTRACT

A practice baseball having a circumference in the range of approximately 65% to 90% of the circumference of an official league baseball and having a weight in the range of approximately 70% to 85% of the weight of an official baseball as required for use in league games by Rule 1.09 of the Official Baseball Rules. Use of the smaller and lighter practice baseball for batting practice should improve the batting skills of a player due to the greater difficulty of hitting the smaller practice baseball. The practice baseball has the same durability and resiliency as an official baseball because it is constructed in a similar manner. The resiliency of the practice baseball is achieved by wrapping the core of the baseball with materials of a tension sufficient to provide a proper coefficient of restitution, one that is similar to the coefficient of restitution of an official baseball.

4 Claims, 1 Drawing Sheet

PRACTICE BASEBALL

TECHNICAL FIELD

The present invention relates generally to sporting equipment and more specifically to an improved ball for use in baseball batting practice.

BACKGROUND OF THE INVENTION

Baseball has been played as an organized sport in this country since the late nineteenth century. The ball used in this sport has remained virtually unchanged since the beginning of baseball. Rule 1.09 of the Official Baseball Rules, which governs amateur and professional baseball in the United States, provides that a baseball shall be a sphere formed by yarn wrapped around a small core of cork, rubber or other similar material covered with two strips of white horsehide or cowhide tightly stitched together. This Rule also requires that a baseball weigh between five and five and one-quarter ounces and have a circumference between nine and nine and one-quarter inches.

Becoming a proficient batter is a difficult task in view of the skill of pitchers to cause the ball to curve through the air, change speeds, and otherwise make it difficult to determine the exact location of the ball when it arrives in the batter's box. Thus, baseball players spend a great deal of time refining their batting skills in batting practice. The goal of batting practice is to improve a player's ability to hit the ball more consistently. The baseball utilized during batting practice traditionally has been the baseball required by the Official Baseball Rules. While batting practice is absolutely required in honing a player's batting skills, new methods and innovations in batting practice are constantly being sought to further refine a player's batting skills.

One example of a new method and innovation in batting practice is the batting practice baseball and method disclosed in U.S. Pat. No. 4,614,339 to Stephen Schanwald. The Schanwald patent discloses a baseball of reduced circumference and diameter, but which is specifically designed to maintain the regulation weight of five to five and one-quarter ounces of a regulation baseball. The inventor herein attempted to manufacture such a baseball utilizing the regulation materials (yarn wound around a small core of cork, rubber or similar material), but was unable to achieve the required weight. It was found that it is only possible to achieve the required weight of at least five ounces by utilizing a steel core within the baseball.

The use of a steel core within a batting practice baseball was found to have several drawbacks. Most important, the baseball did not have the same dynamic characteristics of a regulation baseball. Since the steel core did not have the same density and resilience of cork or rubber, the ball reacted much differently when hit by a bat. In addition, the ball would become damaged more quickly because of the higher density non-resilient core upon impact with a bat.

In addition, the movement of the ball through the air was quite different than a regulation baseball, since the proportional weight for a small diameter baseball was greatly increased. Thus, the expected rate at which the ball would fall through the air would be increased relative to the smaller size, when compared with the rate of drop of a regulation baseball.

Since the skill of the batter in hitting the baseball is based not only upon the size of the object to be hit, but the characteristics of the ball travelling through the air, the use of a smaller dimensioned ball with the same weight as a regulation baseball failed to provide the dynamic characteristics of a ball travelling through the air which would assist in refining batting skills.

SUMMARY OF THE INVENTION

It is therefore a general object of the present invention to provide an improved baseball for use in batting practice.

Another object of the present invention is to provide a new and improved baseball for use in batting practice which is dimensionally smaller in weight and size than a regulation baseball used in game situations, but with the same "feel" and dynamic characteristics.

Yet another object of the present invention is to provide a baseball which is more difficult and challenging to hit in batting practice than a regulation baseball.

Still another object of the present invention is to provide a baseball for use in batting practice which will improve the player's ability to hit a regulation baseball.

The practice baseball of the present invention is proportionally smaller in weight and size than the official baseball required by Official Baseball Rule 1.09 for use in league play. The circumference and diameter of the practice baseball is in the range of approximately 65% to approximately 90% of the circumference and diameter of a regulation baseball. The weight of the practice baseball is approximately 70% to 85% of the weight of the official baseball required by the Rule 1.09 for use in league games. The reduced weight and size of the practice baseball make it more challenging for a batter to hit than the larger official baseball.

In order to provide the same feeling and resilience of an official baseball, the practice baseball is constructed with the same materials as the official baseball. This provides a practice baseball with a tension and coefficient of restitution similar to an official baseball.

By conducting batting practice with the smaller and lighter practice baseball, this should result in further refining the batting skills of a player and make the task of hitting the larger official baseball much easier.

DESCRIPTION OF THE PREFERRED EMBODIMENT

Figure 1:
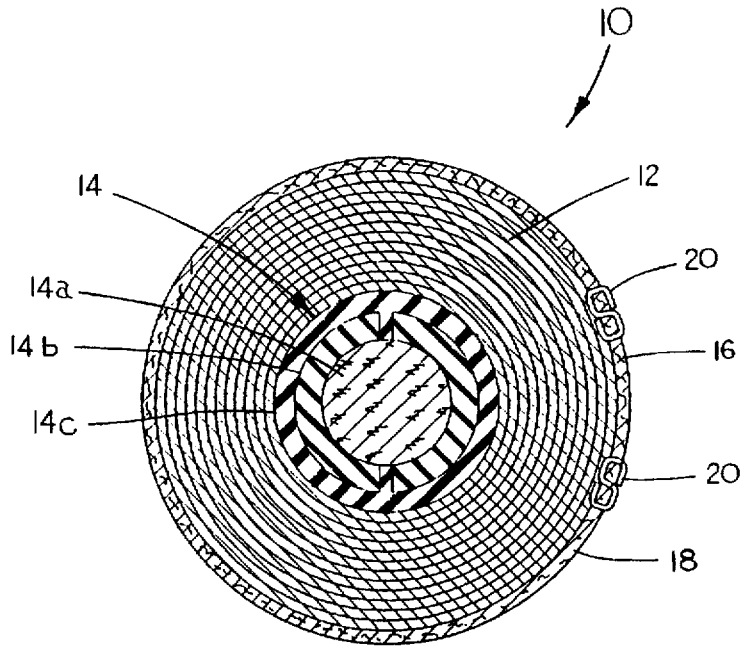
FIG. 1 is a cross-sectional view of the practice baseball of the present invention.

In reference to the drawing, the practice baseball of the present invention is designated generally at 10 and formed by winding yarn 12, cotton or similar material around a central core 14 of cork and rubber. Core 14 preferably includes an inner spherical core **14*a* of cork, surrounded by a hollow spherical intermediate core 14*b* of rubber material, and surrounded by a hollow spherical outer core 14*c* of cured and vulcanized rubber. The yarn 12 is wound tightly, in the form of a sphere, and covered with two pieces 16 and 18 of leather, typically either white horsehide or cowhide. The two pieces 16 and 18 of leather are tightly stitched together by weaving red cotton thread 20 to join the two pieces of leather which create the seams of the baseball. All materials utilized to manufacture the practice baseball 10** are those officially recognized under Rule 1.09 of the Official Baseball Rules.

An official baseball, according to Rule 1.09 of the Official Baseball Rules, has a circumference between nine and nine and one-quarter inches. This results in an outer diameter of not less than 2.87 but no more than 2.95 inches. The weight of an official baseball is between five and five and one-quarter ounces avoirdupois. Preferably, a regulation baseball has a cork core with a diameter of about 0.875 inches, and a vulcanized rubber outer core with a diameter of about 1.3125 inches.

The practice baseball 10 of the present invention is approximately 65% to 90% of the size and weight of a regulation baseball. Thus, the circumference of practice baseball 10 is approximately 5.85 to 8.33 inches, and the outer diameter of the practice baseball 10 is approximately 1.86 to 2.65 inches.

The preferred embodiment of the invention has dimensions and weight approximately 76% of the circumference and diameter of a regulation baseball. Thus, the preferred diameter is approximately 2.21 inches and the preferred weight is approximately 3.8 ounces.

It is important that the practice baseball have the same "feel", resiliency and dynamic characteristics of a regulation baseball, and therefore the inner core, intermediate cover, outer core and yarn windings are all proportionally reduced in diameter and weight.

Following this procedure, a new and improved practice baseball 10 for use in batting practice is provided that is smaller in dimension and weight than an official baseball but has the same feel to a player as a regulation baseball when hit by a player during batting practice.

Whereas the invention has been shown and described in connection with the preferred embodiment thereof, it will be understood that many modifications, substitutions and additions may be made which are within the intended broad scope of the appended claims.

I claim:

1. A practice baseball for use in batting practice having dimension and weight proportionally less than that of a regulation baseball, comprising:

a central core with yarn tightly wrapped therearound to form a spherical interior portions, said central core having a diameter in the range of 0.85 inches to 1.18 inches;

an outer cover of two pieces of leather stitched together to form a tightly wrapped outer surface on the practice baseball;

said practice baseball having an outer diameter measured at the outer surface in the range of 1.86 to 2.65 inches and having a total weight in the range of 3.25 to 4.725 ounces.

2. The practice baseball of claim 1, wherein the diameter of the ball is approximately 2.21 inches and the weight of the ball is approximately 3.8 ounces.

3. The practice baseball of claim 2, wherein said central core includes a spherical cork inner core with a diameter of approximately 0.665 inches, and a vulcanized rubber outer core surrounding the inner core with a diameter of approximately 0.9975 inches.

4. A practice baseball having dimensions and weight proportionally less than that of a regulation baseball, comprising:

a central core formed of the same materials as a regulation baseball core and having a diameter in the range of 65% to 90% of the diameter of a regulation baseball;

an outer cover of two pieces of the same material as a regulation baseball cover, stitched together to form a tightly wrapped outer surface on the practice baseball;

said practice baseball having an outer diameter measured at the outer surface in the range of 65% to 90% of the diameter of a regulation baseball; and said practice baseball having a total weight in the range of 65% to 90% of a regulation baseball.

* * * * *